US007294354B2

(12) United States Patent
Gunter et al.

(10) Patent No.: US 7,294,354 B2
(45) Date of Patent: Nov. 13, 2007

(54) CONTAINER WITH GAS RELEASE FEATURE

(75) Inventors: James Gunter, Hartsville, SC (US); Floyd Needham, Hartsville, SC (US); James Scannella, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 10/977,009

(22) Filed: Oct. 29, 2004

(65) Prior Publication Data

US 2006/0096982 A1 May 11, 2006

(51) Int. Cl.
*B65D 81/00* (2006.01)
*B65D 33/01* (2006.01)
*B65D 90/32* (2006.01)

(52) U.S. Cl. ..... 426/118; 426/123; 383/100; 220/89.1

(58) Field of Classification Search ..... 53/467, 53/471, 266.1; 426/118, 123, 392, 395, 419; 383/103, 100; 428/118, 123, 392, 395, 419; 220/89.1, 89.2
See application file for complete search history.

(56) References Cited

U.S. PATENT DOCUMENTS 2,173,571 A * 9/1939 Jesnig ..... 137/854
2,224,296 A 12/1940 Hoffman
2,361,344 A 10/1944 Yates
3,380,621 A * 4/1968 Rissberger, Jr. et al. . 220/203.1
3,432,087 A * 3/1969 Costello ..... 383/103
3,595,467 A 7/1971 Goglio
4,000,846 A * 1/1977 Gilbert ..... 383/103
4,122,993 A 10/1978 Glas
4,134,535 A * 1/1979 Barthels et al. ..... 383/102
4,653,661 A 3/1987 Buchner et al.
4,715,494 A * 12/1987 Heitzenroder et al. ... 206/213.1
4,966,780 A * 10/1990 Hargraves et al. ..... 426/118
5,125,542 A 6/1992 Blanc
5,295,603 A * 3/1994 Schormair et al. ..... 220/789
5,326,176 A * 7/1994 Domke ..... 383/103
5,351,845 A * 10/1994 Hunter ..... 215/225
5,354,133 A * 10/1994 Rapparini ..... 383/103
5,515,994 A 5/1996 Goglio
5,727,881 A 3/1998 Domke
5,992,442 A 11/1999 Urquhart et al.
5,992,635 A 11/1999 Walters (Continued)

FOREIGN PATENT DOCUMENTS

GB 2 096 980 * 10/1982

*Primary Examiner*—Rinaldi I. Rada
*Assistant Examiner*—Paul Durand
(74) *Attorney, Agent, or Firm*—Alston & Bird LLP

(57) ABSTRACT

A gas release container comprises a container body having a bottom wall and a side wall extending upwardly from the bottom wall and terminating at an upper edge, a removable closure affixed to the upper edge in a substantially gas-tight manner, and a gas release valve in a wall of the container body and operable to release gas from the container when the pressure differential between the interior and the exterior of the container is sufficient to open the valve. The removable closure can include a flexible gas-barrier membrane sealed to the upper edge of the container body. A lower surface of the membrane and the upper edge of the side wall comprise heat-sealable polymer materials, and the membrane is heat-sealed to the upper edge, preferably by induction sealing. The closure can include an overcap.

21 Claims, 2 Drawing Sheets

U.S. PATENT DOCUMENTS 6,089,271 A * 7/2000 Tani ..... 137/854
6,213,645 B1 4/2001 Beer
6,367,651 B2 4/2002 Laib et al.
6,662,827 B1 12/2003 Clougherty et al.
6,814,991 B2 * 11/2004 Hiyoshi ..... 426/113
2002/0178202 A1 * 11/2002 Steele, Jr. ..... 708/503

* cited by examiner

CONTAINER WITH GAS RELEASE FEATURE

BACKGROUND OF THE INVENTION

This invention relates to containers for products that tend to release gases after filling and sealing of the containers, and relates in particular to containers having a gas release vent or valve for releasing excessive gases built up within the container.

Some products, such as freshly roasted and ground coffee or yeast dough, tend to give off gases for a period of time after their preparation. For instance, when coffee that has been freshly roasted is ground, the coffee releases carbon dioxide and other gaseous substances for days or weeks. Similarly, freshly prepared yeast dough also releases carbon dioxide for a substantial period of time. In the case of ground coffee, because of the gas release, also known as off-gassing, it has customarily been the practice to store the freshly ground coffee for some time before packaging it, so as to avoid the sealed coffee packages being deformed or even failing as a result of the build-up of gas pressure in the packages. However, it has also been recognized that storing the ground coffee prior to packaging potentially can result in the loss of some beneficial aromatic and flavor compounds from the coffee.

Accordingly, containers have been developed that have provisions for releasing excess gas pressure from the containers so that an off-gassing product can be immediately packaged. In the case of ground coffee, this can help reduce the loss of desirable aromatic or flavor components. The prior art exhibits two basic approaches to the problem of relieving excessive gas pressure from containers for off-gassing products such as coffee or dough. One approach is exemplified by flexible coffee bags such as those described in U.S. Pat. No. 3,595,467 to Goglio, U.S. Pat. No. 5,326,176 to Domke, and U.S. Pat. No. 5,992,635 to Walters. The bags are produced from flexible web materials having gas-barrier properties. A one-way gas release valve is provided in the flexible web material. The valve allows gas to escape from the bag when the gas pressure becomes excessive, but substantially prevents air from entering the bag through the valve. Such flexible coffee bags can be prone to malfunctioning of the valve as a result of wrinkling or other deformation of the flexible material. Additionally, the bags generally are reclosable only by rolling the top of the bag down and securing the top in the rolled position using an attached wire strip or the like. Such reclosing mechanisms are inconvenient to use.

The other basic approach in the prior art to the problem of relieving excessive gas pressure from containers for off-gassing products is exemplified by rigid or semi-rigid containers such as those described in U.S. Pat. No. 5,515,994 to Goglio and U.S. Pat. No. 6,733,803 to Vidkjaer. The rigid or semi-rigid containers of these patents include a flange on the upper edge of the container wall to provide a relatively large sealing surface for the attachment of a flexible membrane lid to seal the container closed. A one-way gas release valve is provided in the flexible membrane lid for relieving excessive gas pressure. Such membrane lids with gas release valves generally must be conduction heat-sealed to the flange, which is a relatively slow process. A further drawback to containers of this type arises when a replaceable overcap is included for reclosing the container after the membrane lid is removed. Because excess gas is vented through the valve in the membrane lid, the overcap or its attachment to the container must also include a provision to vent the gas, or else the overcap could prevent the valve from fulfilling its intended function. Such venting provision in the overcap may at least partially negate the resealing function of the overcap unless special steps are taken to design the venting provision in such a way that it functions to vent the released gases but does not allow air to enter the container after replacement of the overcap.

BRIEF SUMMARY OF THE INVENTION

The present invention addresses the above-noted shortcomings of prior gas release containers and achieves other advantages, by providing a container comprising a container body having a bottom wall and a side wall extending upwardly from the bottom wall and terminating at an upper edge, a removable closure affixed to the container body and sealed to the upper edge in a substantially gas-tight manner, and a gas release valve in a wall of the container body and operable to release gas from the container when the pressure differential between the interior and the exterior of the container is sufficient to open the valve.

The container body advantageously is a generally rigid or semi-rigid structure, as distinguished from flexible coffee bags or the like, and can be formed entirely or at least substantially entirely of polymer material(s). In some embodiments of the invention, the container body comprises a blow-molded can, which can be formed by extrusion blow molding, injection stretch-blow molding, or the like.

The gas release valve comprises one or more holes formed through the container wall, and a valve arrangement affixed to the side wall in fluid communication with the hole(s). Various valve arrangements can be employed. One suitable type of valve includes a flexible film outer layer bonded to a polymer base material, wherein the interface between the outer layer and the base defines a gas escape channel that is sealed by an embedded liquid such as a silicone-based liquid. The base defines a passage that provides a gas pathway between the hole(s) in the container wall and the gas escape channel of the valve.

The removable closure can include a flexible gas-barrier membrane sealed to the upper edge of the container body. In preferred embodiments of the invention, a lower surface of the membrane and the upper edge of the side wall comprise heat-sealable polymer materials, and the membrane is heat-sealed to the upper edge. The upper edge can have a flange to which the membrane is sealed, or the upper edge can be flangeless.

The membrane can comprise an induction-sealable membrane and can be induction-sealed to the upper edge of the side wall. As noted, conduction sealing is used for attaching prior membranes that include a gas release valve because the electrical current that is passed through the membrane during induction sealing tends to damage the valve. With the elimination of the valve from the membrane, the invention allows the use of induction sealing, which is substantially faster than conduction sealing.

The removable closure can also include an overcap. The overcap can be attached to the container in various ways, such as by a friction or snap fit, or by threads. The overcap is applied to the container over the membrane in preferred embodiments. The consumer can remove the overcap, peel off the membrane and discard it, and then can replace the overcap to keep the remaining product in the container fresh. When the membrane is an induction-sealable membrane, the overcap and the membrane can be assembled together as a unit and then applied to the container and induction sealed in a single operation. This is much more efficient than conduction sealing a membrane to the container and then applying an overcap in separate operations.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

Figure 1:
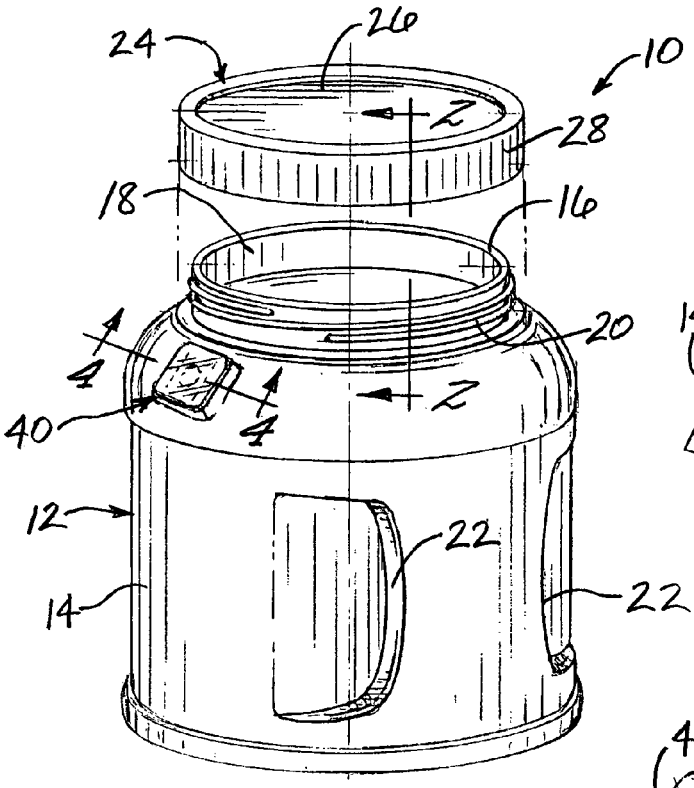
FIG. 1 is a perspective view of a container in accordance with one embodiment of the invention.
Figure 2:
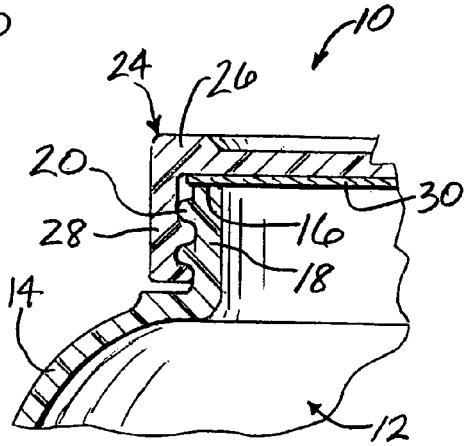
FIG. 2 is a cross-sectional view along line 2-2 in FIG. 1, showing details of the container closure.
Figure 3:
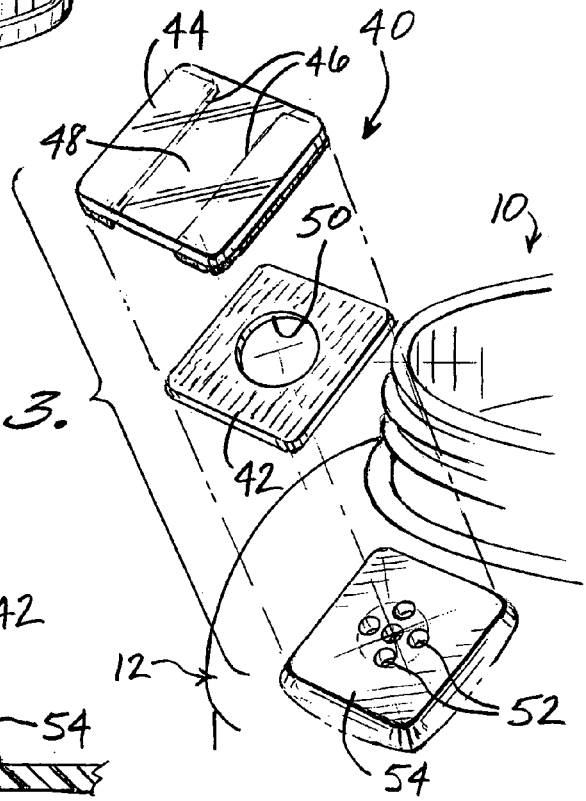
FIG. 3 is an exploded view of the gas release valve of the container.
Figure 4:
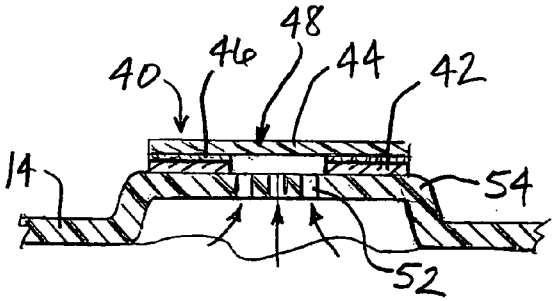
FIG. 4 is a cross-sectional view of the valve along line 4-4 in FIG. 1.

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

A container 10 in accordance with one embodiment of the invention is depicted in FIGS. 1-4. The container includes a container body 12 of molded plastic construction. The container body can be formed by a blow-molding process or other suitable process, and has substantial rigidity in comparison with flexible coffee bags or the like. The container body can be formed of various polymer materials including but not limited to polyethylene, polypropylene, and the like. The container body includes a side wall 14 of generally tubular form that extends upwardly from a bottom wall of the container body and terminates at an upper edge 16. In the illustrated embodiment, the side wall has a portion at its upper end forming a neck 18 whose radially outer surface has one or more threads 20 formed thereon. The container body also can define a handle feature in the side wall 14, if desired. The depicted container body has a handle feature formed by a pair of recesses 22 in the side wall to facilitate gripping the container body.

The container includes a closure assembly 24 comprising an overcap 26 that has an internally threaded skirt 28 for engaging the threads 20 on the container body neck 18. The closure assembly also includes a flexible membrane liner 30 on the underside of the overcap 26. The liner 30 is sealed to the upper edge 16 of the container body to hermetically seal the contents of the container inside. The liner advantageously is pre-assembled with the overcap to form the closure assembly 24 prior to applying the closure assembly to the container body; for example, the liner can be adhered to the underside of the overcap. The liner preferably can be heat-sealed to the upper edge of the container body. Accordingly, the container body and at least the lower surface of the liner can be formed of heat-sealable materials. Various heat-sealable materials can be used, including but not limited to polyethylene, polypropylene, ionomer resins such as SURLYN®, and the like.

In preferred embodiments of the invention, the liner 30 comprises an induction-sealable membrane. Such membranes are in themselves known, and typically comprise a metal foil/polymer laminate construction with or without additional layers. Induction sealing is a process wherein a sealing head is placed closely proximate the top surface of the overcap after the overcap has been applied to the container. The liner 30 must be firmly abutting the upper edge 16 of the container. An inductive coil inside the sealing head is energized by electric current and creates an electromagnetic field. The electromagnetic field induced eddy currents in the metal foil layer of the liner, which causes the foil to become hot. This causes the heat-sealable polymer layer on the underside of the foil to melt and adhere to the upper edge of the container body, thus forming a seal. In preferred embodiments of the invention, the application of the closure assembly 24 to the container and the induction sealing of the liner are integrated such that they comprise a single process step.

The container 10 also includes a gas release valve 40 in a wall of the container body. In the illustrated embodiments, the valve is placed in the side wall 14 of the container body. With primary reference to FIGS. 3 and 4, the gas release valve in one embodiment can comprise a membrane type of valve formed by a base 42 and a flexible membrane 44 joined atop the base by adhesive 46. There is an adhesive-free zone 48 in a central region of the membrane 44 at which the membrane is not affixed to the base 42. In alignment with the adhesive-free zone, the base has an opening 50 that is in fluid communication with one or more holes 52 formed through the container side wall 14. A viscous oil (not shown) such as silicone oil or the like is disposed between the membrane 44 and the base 42 for sealing of the valve such that the valve is normally closed. The valve operates as a one-way valve substantially preventing air from entering the container through the valve, but allowing gas inside the container to escape out through the valve when the pressure differential between inside and outside the container becomes greater than a threshold level. When the pressure differential is zero, the membrane 44 is normally in a position against the outer surface of the base 42 so as to close the valve. When the pressure differential becomes great enough to lift the membrane away from the base, a gas escape pathway is formed therebetween.

The base 42 can comprise a polymer material such as high-density polyethylene, polyvinyl chloride, or the like. The base can be attached to the container side wall by a suitable adhesive such as a pressure-sensitive adhesive. The base is generally substantially thicker and stiffer than the membrane 44. The membrane 44 can comprise a metallized polymer film such as metallized polyethylene terephthalate or the like, or any other suitable membrane providing oxygen and moisture barrier performance as needed.

As shown, the container side wall 14 can define a raised region or boss 54 to which the valve 40 is affixed. The valve 40 can be located in various places on the container body. Thus, although illustrated in the drawings as being located on an upper portion of the side wall, the valve alternatively can be placed on a middle or lower portion of the side wall or on the bottom wall.

The invention is not limited to any particular type of gas release valve, and other types of valves can be used instead of the above-described membrane type valve.

Figure 5:
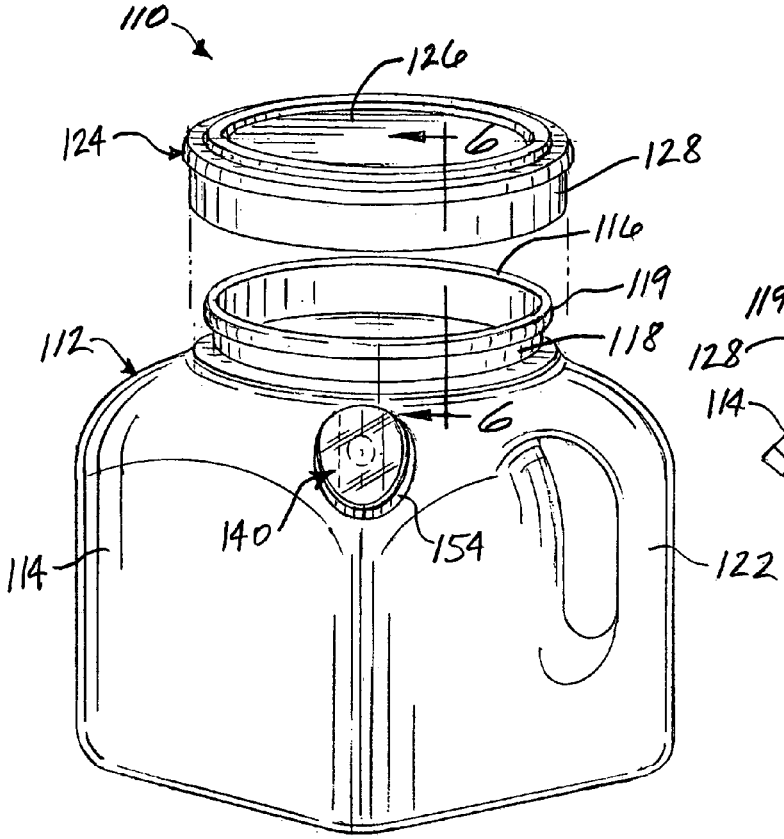
FIG. 5 is a perspective view of a container in accordance with another embodiment of the invention.
Figure 6:
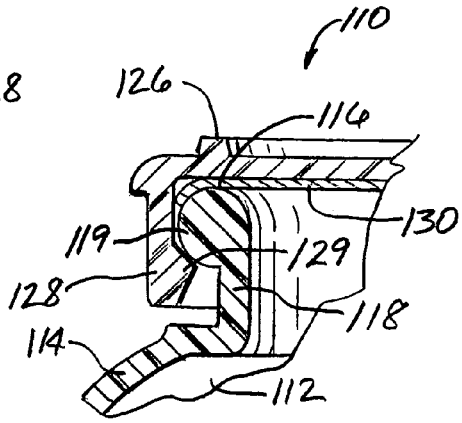
FIG. 6 is a cross-sectional view along line 6-6 in FIG. 5, showing details of the container closure.

A container 110 in accordance with another embodiment of the invention is illustrated in FIGS. 5 and 6. The container comprises a container body 112 formed of plastic by blow-molding or other suitable process. The container body can be formed of various polymer materials including but not limited to polyethylene, polypropylene, and the like. The container body 112 has a side wall 114 that extends upwardly and defines a neck 118 at its upper end. The top of the neck defines a radially outwardly extending rim or flange 119 that forms the upper edge 116 of the container body. In comparison with a straight-wall upper edge as in the first embodiment, the flange 119 provides a larger sealing surface for attachment of a membrane liner. Additionally, the flange cooperates with an overcap to retain the overcap in place as described below. The container body can also include a handle 122 of any suitable configuration, such as the illustrated hollow handle.

The container also includes a closure assembly 124 comprising an overcap 126 having a skirt 128 whose inner surface defines a bead or protrusion 129 that snaps beneath the flange 119 of the container body when the overcap is fully seated atop the container as in FIG. 6. The overcap 126 thus is a snap-on type of cap, as opposed to the threaded overcap of the first embodiment. In other respects, the closure assembly 124 is generally similar to the closure assembly 24 of the first embodiment. Thus, the closure assembly 124 includes a flexible membrane liner 130 that is sealed to the upper edge 116 of the container body defined by the flange 119. The liner 130 advantageously comprises an induction-sealable membrane and is induction sealed to the flange in the manner previously described.

The container 110 includes a gas release valve 140 mounted to the side wall 114 of the container body, such as on a raised region or boss 154 as shown. The valve 140 can be formed and can operate in essentially the same manner as the previously described valve 40.

Containers in accordance with the invention can be used for containing various products that tend to off-gas, such as ground coffee or the like. A significant advantage of the invention is that the incorporation of the gas release valve in the container body enables the container to be hermetically sealed by a flexible membrane closure, such as the liners 30, 130 or the like, and the membrane closure can be induction sealed to the container. Induction sealing is much faster than conduction sealing. In conventional rigid containers having a gas release valve, the valve is incorporated in the membrane closure, which prevents the usage of induction sealing because the electrical current induced in the membrane can damage the valve. Therefore, the valved membrane closures must be conduction sealed to the containers, which is slow. The invention provides a gas-release container that can be sealed by the much faster induction sealing process.

Additionally, conventional containers having the valve in the membrane closure and also having an overcap must provide some type of gas release feature in the overcap or its connection with the container, or else the overcap would prevent the gas from releasing properly. This additional complication is avoided by the invention because the gas release valve is incorporated in the container body.

A method of packaging a product in accordance with the invention includes steps of providing a container body having a bottom wall and a side wall extending upwardly from the bottom wall and terminating at an upper edge, placing the product into the container body, providing a gas release valve in one wall of the container body and operable to release gas from the container when the pressure differential between the interior and the exterior of the container is sufficient to open the valve, and affixing a closure to the container body and sealing the closure to the upper edge in a substantially gas-tight manner so as to enclose the product in the container. The closure preferably includes a membrane that is induction sealed to the container. It is advantageous for the membrane to comprise a liner in an overcap. The overcap and liner assembly is applied to the container body (by screwing in the case of a threaded overcap and container, or by pushing straight downward in the case of a snap-on overcap) and is induction sealed substantially simultaneously.

Containers in accordance with the invention are thus hermetically sealed to substantially prevent infiltration of air into the container until the consumer initially opens the container. Opening of the container is initiated by unscrewing or prying the overcap from the container. Depending on how the membrane liner is arranged in the overcap, removal of the overcap may or may not cause the liner to be peeled from the container body. If the liner remains attached to the container after removal of the overcap, the liner is then peeled off to access the container contents. The container is re-closed by replacing the overcap.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A container with gas release feature, the container comprising:

a rigid or semi-rigid container body having a bottom wall, a side wall extending upwardly from the bottom wall, and a neck of smaller diameter than the side wall, an upper portion of the side wall defining a shoulder forming a transition between the side wall and the neck, the shoulder decreasing in diameter in an upward direction toward the neck, the neck terminating at an upper edge encircling an opening of the container body;

a removable closure affixed to the upper edge in a substantially gas-tight manner, the upper edge and the closure being configured to render the closure replaceable by re-engaging the closure with the upper edge for re-closing the opening after initial removal of the closure; and a gas release valve in the shoulder of the container body and operable to release gas from the container when the pressure differential between the interior and the exterior of the container is sufficient to open the valve.

2. The container of claim 1, wherein the container body is formed substantially entirely of polymer material.

3. The container of claim 2, wherein the container body comprises a blow-molded can.

4. The container of claim 1, wherein the gas release valve includes one or more holes formed through the side wall of the container body, and a valve arrangement formed separately from and affixed to the container body side wall in fluid communication with said one or more holes.

5. The container of claim 4, wherein the valve arrangement comprises a base of polymer material and a flexible film outer layer bonded to the base, a gas escape channel being defined between the base and the outer layer, the base being affixed to the side wall of the container body in fluid communication with said one or more holes.

6. The container of claim 1, comprising a coffee canister and further comprising a quantity of ground coffee contained in the canister.

7. The container of claim 1, wherein the closure includes a flexible gas-barrier membrane sealed to the upper edge of the container body.

8. The container of claim 7, wherein a lower surface of the membrane and the upper edge comprise heat-sealable polymer materials, and the membrane is heat-sealed to the upper edge.

9. The container of claim 8, wherein the upper defines a flange to which the membrane is heat-sealed.

10. The container of claim 8, wherein the upper edge is flangeless.

11. The container of claim 8, wherein the membrane is an induction-sealable membrane and is induction-sealed to the upper edge.

12. The container of claim 8, wherein the closure further comprises an overcap having a top panel and a peripheral skirt depending therefrom, the panel having a lower surface, the overcap being affixed to the container body over the membrane.

13. The container of claim 12, wherein the membrane is an induction-sealable membrane and is induction-sealed to the upper edge.

14. The container of claim 13, wherein the container body is threaded adjacent the upper edge and the overcap is threaded along an inner surface of the skirt, and the overcap is screwed onto the container body over the membrane.

15. A container with gas release feature, the container comprising:

a rigid or semi-rigid plastic container body having a bottom wall, a side wall extending upwardly from the bottom wall, and a neck of smaller diameter than the side wall, an upper portion of the side wall defining a shoulder forming a transition between the side wall and the neck, the shoulder decreasing in diameter in an upward direction toward the neck, the neck terminating at an upper edge encircling an opening of the container body, the container body being formed by one of blow molding and injection molding;

a removable closure affixed to the upper edge in a substantially gas-tight manner, the upper edge and the closure being configured to render the closure replaceable by re-engaging the closure with the upper edge for re-closing the opening after initial removal of the closure; and a gas release valve in the shoulder of the container body and operable to release gas from the container when the pressure differential between the interior and the exterior of the container is sufficient to open the valve, wherein the gas release valve includes one or more holes formed through the shoulder of the container body, and a valve arrangement formed separately from and affixed to the container body wall in fluid communication with said one or more holes.

16. The container of claim 15, wherein the valve arrangement comprises a base of polymer material and a flexible film outer layer bonded to the base, a gas escape channel being defined between the base and the outer layer, the base being affixed to the outer surface of the wall of the container body in fluid communication with said one or more holes.

17. The container of claim 15, wherein the closure includes a flexible gas-barrier membrane sealed to the upper edge of the side wall of the container body.

18. The container of claim 17, wherein a lower surface of the membrane and the upper edge of the container body comprise heat-sealable polymer materials, and the membrane is heat-sealed to the upper edge.

19. The container of claim 18, wherein the upper edge defines a flange to which the membrane is heat-sealed.

20. The container of claim 18, wherein the upper edge sidewall is flangeless.

21. The container of claim 18, wherein the membrane is an induction-sealable membrane and is induction-sealed to the upper edge.

* * * * *

UNITED STATES PATENT AND TRADEMARK OFFICE

CERTIFICATE OF CORRECTION

PATENT NO. : 7,294,354 B2
APPLICATION NO. : 10/977009
DATED : November 13, 2007
INVENTOR(S) : Gunter et al.

It is certified that error appears in the above-identified patent and that said Letters Patent is hereby corrected as shown below:

Column 7, Claim 9
Line 13, after "upper" insert --edge--.

Column 8, Claim 20
Line 35, cancel "sidewall".

Signed and Sealed this

Twentieth Day of May, 2008

JON W. DUDAS
*Director of the United States Patent and Trademark Office*